US008746630B2

(12) United States Patent
Ossberger et al.

(10) Patent No.: US 8,746,630 B2
(45) Date of Patent: Jun. 10, 2014

(54) SWITCH WITH MOVABLE FROG POINT

(75) Inventors: Heinz Ossberger, Mursiedlung (AT); Thomas Klemen, Hauergasse (AT); Gernot Krenn, Haupstrasse (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 167 days.

(21) Appl. No.: 12/735,372

(22) PCT Filed: Jan. 12, 2009

(86) PCT No.: PCT/AT2009/000007
§ 371 (c)(1),
(2), (4) Date: Aug. 30, 2010

(87) PCT Pub. No.: WO2009/089558
PCT Pub. Date: Jul. 23, 2009

(65) Prior Publication Data

US 2011/0011986 A1 Jan. 20, 2011

(30) Foreign Application Priority Data

Jan. 14, 2008 (AT) ..... A 53/2008

(51) Int. Cl.
*E01B 7/14* (2006.01)
*E01B 5/14* (2006.01)

(52) U.S. Cl.
USPC ..... 246/385; 246/382; 238/149

(58) Field of Classification Search
USPC ..... 246/382, 383, 384, 385, 386, 387, 389, 246/390, 391, 392; 238/167, 122, 124, 149; 72/377
See application file for complete search history.

(56) References Cited

U.S. PATENT DOCUMENTS

| | | | | |
|---|---|---|---|---|
| 3,518,423 | A | 6/1970 | Birnbacher | |
| 4,953,814 | A * | 9/1990 | Oswald et al. | 246/382 |
| 5,611,234 | A * | 3/1997 | Allegrucci et al. | 72/377 |
| 5,704,998 | A * | 1/1998 | Gallagher, Jr. | 148/648 |
| 6,442,824 | B2 * | 9/2002 | Stanley et al. | 29/557 |

FOREIGN PATENT DOCUMENTS

| | | |
|---|---|---|
| DE | 874 981 | 4/1953 |
| DE | 1 658 316 | 8/1970 |
| DE | 1 708 647 | 10/1971 |
| EP | 0 343 150 A2 | 11/1989 |

* cited by examiner

*Primary Examiner* — Mark Lee
(74) *Attorney, Agent, or Firm* — Taft Stettinius & Hollister LLP

(57) ABSTRACT

In a switch including a switch frog (1) with a movable frog point (2) and wing rails (5, 6), wherein the wing rails (5, 6) in the region of the frog point (2) each have a rail profile which is lower than that of a standard rail, the wing rails (5, 6) are designed as Vignol rails whose region configured with a lower rail profile is produced by metal-forming departing from the Vignol rail profile.

14 Claims, 3 Drawing Sheets

SWITCH WITH MOVABLE FROG POINT

The invention relates to a switch including a switch frog with a movable frog point and wing rails, wherein the wing rails in the region of the frog point each have a rail profile which is lower than that of a standard rail.

BACKGROUND OF THE INVENTION

A switch of this type can, for instance, be taken from EP 0343150 A2.

Frog points are known in various configurations, wherein a two-part movable frog point comprised of a main point and a secondary point is, inter alia, used, wherein both of the connection rails have spring locations. The frog point is surrounded by wing rails, i.e. by the rail tracks continuing from the tongues and bent in the region of the frog point.

In order to enable the unlimited use of common materials for such frog points in rail and switch construction, and in order for the frog to excel at a higher load-bearing capacity and stability, particularly in the region of its point, the configuration known from EP 0343150 A2 provides that the main and secondary points are formed by using thick-web standard rail profiles, and that asymmetrical tongue profiles which are at least partially fixed to tie plates and lower than the thick-web standard rail profiles are provided as outer wing rails. By using thick-web standard rail profiles, the same material can be chosen both for the main and secondary points so as to ensure uniform wear and hence reduced maintenance expenditures. The choice of thick-web standard rail profiles imparts the required stability to the main and secondary points while, at the same time, enhancing the possibility of elastically bracing the wing rail components. The measure to make the outer wing rails lower than the thick-web standard rail profiles of the frog and fix them at least partially to tie plates provides the option to secure the thick-web standard rail profiles against ascending at a pivotal movement of the frog point by its foot portion below the wing rails. Such a configuration is of particular advantage for high-speed switches.

The wing rail portions which are designed as asymmetrical tongue profiles of lower height in the region of the frog are either forged from the lower asymmetrical tongue profile to the standard rail profile in the region immediately before the frog point or mutually adapted and welded with a standard rail that reaches as far as to the beginning of the frog. Furthermore, the wing rail portions are either guided as asymmetrical tongue profiles as far as to the wing rail end or likewise forged from the standard rail profile after the overrun region behind the tongue after the frog points, or mutually adapted and welded with a standard rail that reaches as far as to the wing rail end. The installation of a wing rail according to the EP 0343150 A2 design, which is comprised of an asymmetrical thick-web standard profile, thus requires two profile adaptations and connection welds with the standard rails.

BRIEF SUMMARY OF THE INVENTION

The present invention aims to provide a switch of the initially defined kind, including wing rails which in the region of the frog point each have a rail profile that is lower than a standard rail profile, yet without requiring separate rail profiles and connection welds for the same.

To solve this object, the switch according to the invention is essentially characterized in that the wing rails are designed as Vignol rails whose region configured with a lower rail profile is produced by metal-forming departing from the Vignol rail profile. By the wing rails being designed as Vignol rails, the former can each be produced of a single rail piece so as to render the necessary connection welds superfluous. No separate welded-in wing rail part is required, but a locally confined profile change of the Vignol rail profile will do to form the lower wing rail profile provided in the region of the frog point. To form this lower rail profile, the wing rail according to the invention is produced by metal-forming, departing from the Vignol rail profile. Overall, the heat-affected zone in the region of metal-forming will be substantially reduced by the configuration according to the invention such that no textural changes in the rail head profile of the wing rail will occur, whereby, when selecting the material for the wing rail, no finishing treatment in the rail head otherwise required because of the thermal metal-forming process need be taken into account. Since the wing rails are each produced of a single piece, the running surface of the wheel does not comprise any add-on pieces so as to ensure a uniform running behaviour in the overrun region.

The configuration advantageously is devised such that the region configured with the lower rail profile is produced by metal-forming, departing from the Vignol rail profile while maintaining the rail head profile, for the formation of a lower rail web widening towards the rail foot. Metal-forming in this case is preferably performed after preheating to about 900°, with the standard rail profile being upset so as to form a symmetrically widened rail web having an unchanged rail head profile. To this end, the rail head profile and optionally a portion of the web following the rail head are kept in a suitable shape during the upsetting procedure.

In order to take into account the changed shape of the rail web in this region for the support, it is provided according to a preferred further development that the wing rails are fixed by supports which are screwed with the webs of the wing rails, said supports each having a material taper substantially corresponding to the thickening of the wing rail web such that the supports are adapted to the wing rail portions produced by metal-forming.

In order to ensure that the movable frog point will be able to come into planar abutment on the wing rails, it is provided according to a further preferred configuration that the wing rails are subsequently mechanically treated in the region of abutment of the movable frog point for the formation of an asymmetrical rail cross section.

In order to reduce the risk of ascension of the frog point, the configuration is advantageously devised such that the wing rails in the region of their lower rail profiles each have a profile height that is smaller than the profile height of the frog point by at least the height of the foot of the frog point. The frog point can thus be inserted below the outer wing rail by its foot portion in the respective end position. In this respect, the configuration is advantageously devised such that the wing rails in the region of their lower rail profiles are at least partially arranged on chairs. According to a further preferred configuration, it is provided that the chair end sides facing the frog point comprise recesses for overlapping the foot of the frog point in the abutted position of the frog point.

In order not to affect the stability while, at the same time, increasing the flexibility of the frog point in those regions in which such a support against ascending cannot be readily realized, the configuration is advantageously devised such that the foot of the frog point is designed to be recessed to a smaller width at least in the region of a portion of the chairs of the wing rails.

BRIEF DESCRIPTION OF THE SEVERAL VIEWS OF THE DRAWINGS

In the following, the invention will be explained in more detail by way of an exemplary embodiment schematically illustrated in the drawing. Therein.

DETAILED DESCRIPTION OF THE INVENTION

Figure 1:
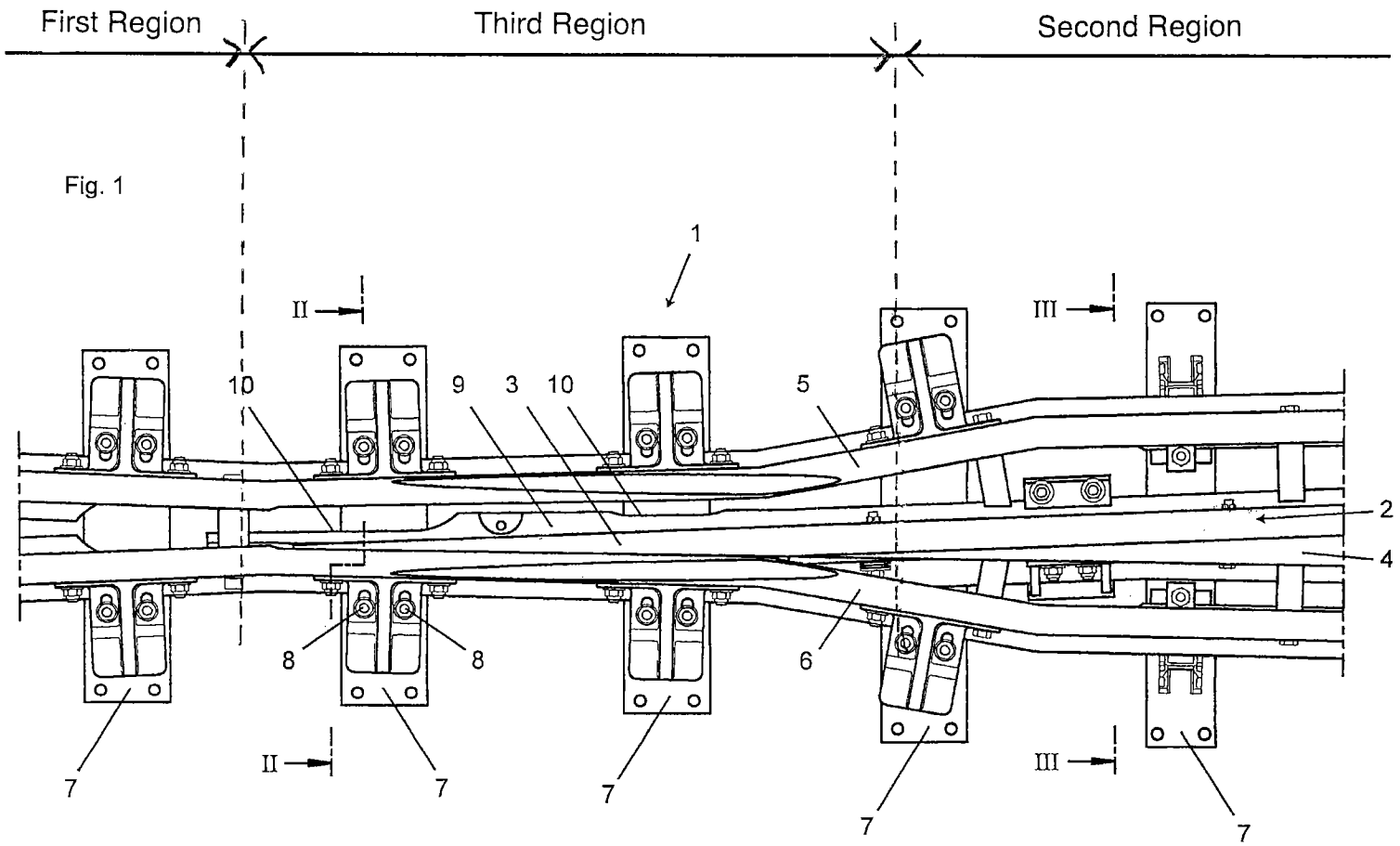
FIG. 1 depicts a sectional top view on a switch according to the invention including a frog with a movable main and secondary point.

In FIG. 1, a frog carrying a frog point 2 with a main point 3 and a secondary point 4 is denoted by 1. The wing rails of the frog 1 are denoted by 5 and 6. The fixation of the wing rails 5 and 6 on tie plates 7 is effected by screws 8. The foot 9 of the main point 3, in the region of fixation of the wing rails 5 to a tie plate 7, partially comprises recesses 10 whose mode of functioning will be explained in more detail below.

Figure 2:
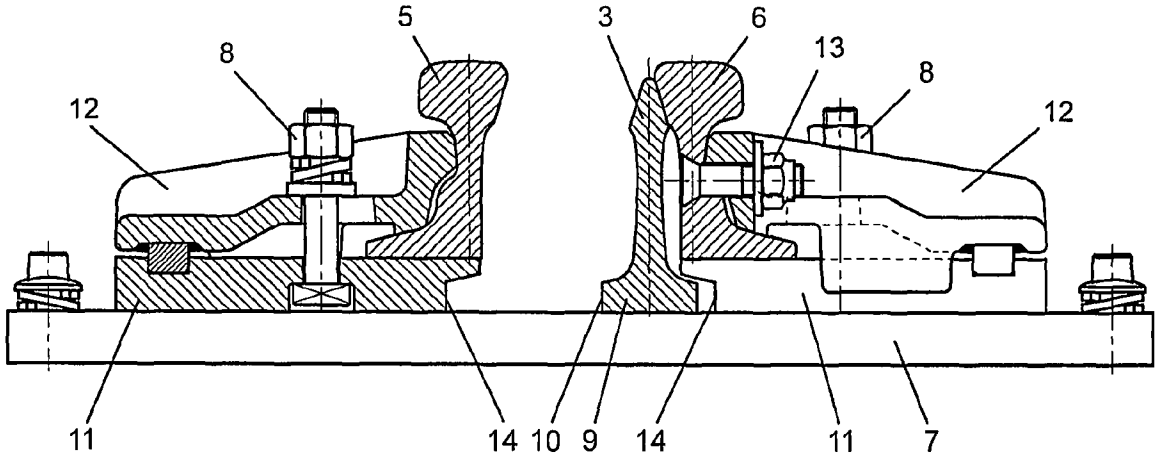
FIG. 2 is a section along line II/II of FIG. 1.

FIG. 2 depicts the main point 3 in abutment on the wing rail 6. The main point is in this case formed by a rail profile, for instance, 54E1 or 60E1 EN13674-1. The wing rails 5 and 6 in the region of abutment of the frog point on the wing rails illustrated here are configured to be asymmetrical and of a lower height, and are adapted to the rail profile used for the point. The wing rails 5 and 6 are each fixed on chairs 11 whose height is dimensioned such that the overall height of the chairs with the lower regions of the wing rails 5 and 6, respectively, will each correspond to the height of the main point 3. The fixation of the wing rails 5 on the chairs 11 is realized in a known manner via supports 12 which are connected with the wing rail by a screw connection 13 and with the chair 11 by a screw connection 8. The chairs 11, on their end faces facing the point 3, each have a recess 14 in which the offset portion 10 of the rail foot 9 of the frog point 3 can engage in the position in abutment on the wing rail. Such an overlap of the chairs 11 will prevent the point 3 from ascending, the chair 11 thus acting as a downholder in the position abutting on the wing rail. The chairs 11 are connected with the tie plates 7 or constitute a common component part therewith. The tie plates 11 are fastened to sleepers or concrete plates no illustrated.

Figure 3:
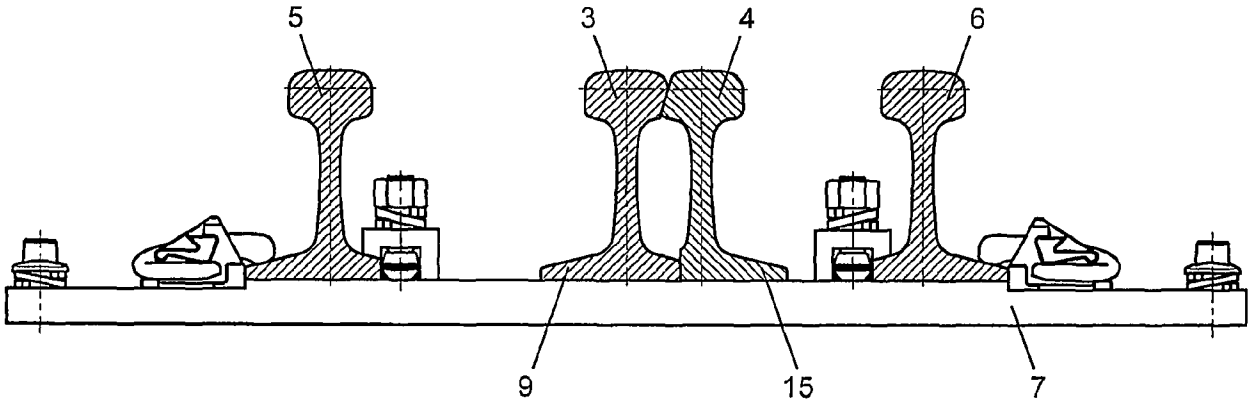
FIG. 3 is a section along line of FIG. 1.

In the illustration according to FIG. 3, the connection of the main point 3 with the secondary point 4 is elucidated. The secondary point 4 is configured in the same manner as the main point 3, using rail profiles as explained above. Like the main point, also the secondary point 4 comprises a rail foot 15 for a more stable design of the frog with a reduced risk of tilting. The wing rails 5 and 6 in the region illustrated have usual Vignol rail profiles and are directly fixed to the tie plates 7.

Figure 4:
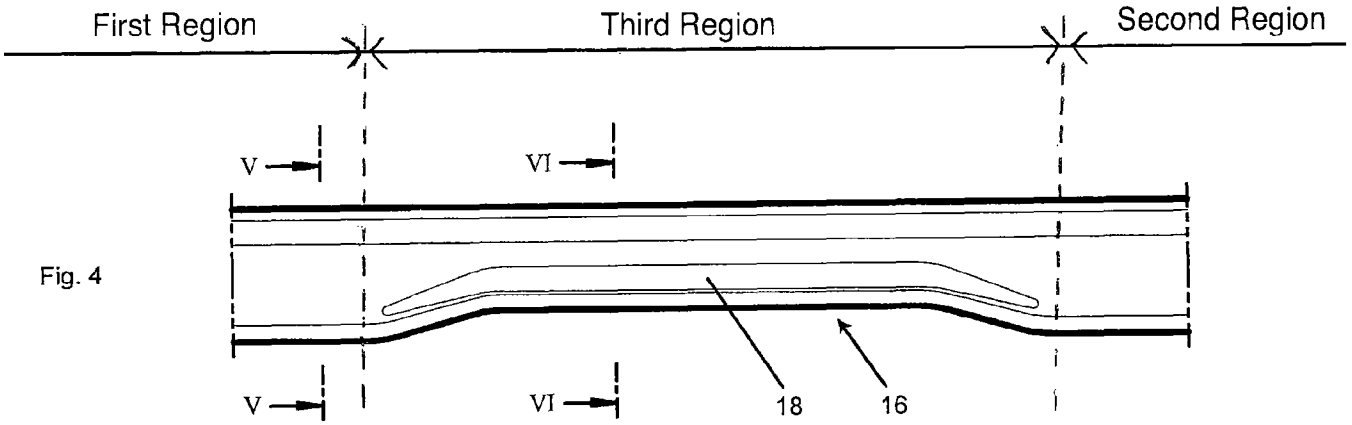
FIG. 4 is a side view of a portion of the wing rail.
Figure 5:
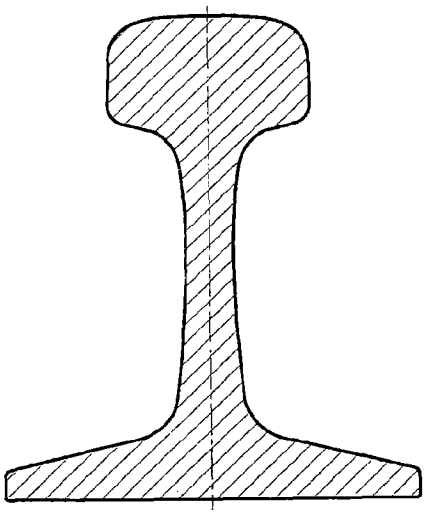
FIG. 5 is a section along line V/V of FIG. 4.
Figure 6:
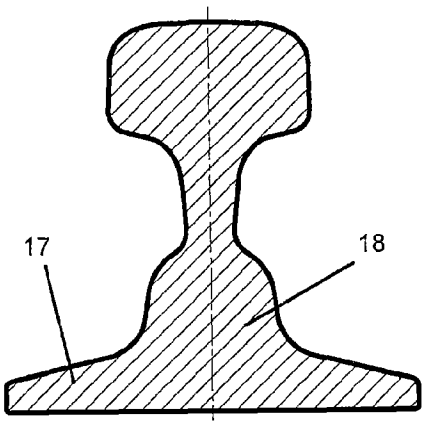
FIG. 6 is a section along line VI/VI of FIG. 4.

The profile course of the wing rails 5 and 6 designed as Vignol rails is even more clearly apparent from the illustrations according to FIGS. 4 to 6. From FIG. 4, which depicts a portion of the wing rail, it is apparent that the wing rail has a lower profile height in a region 16, which is produced by metal-forming. With larger frogs, the metal-forming region of the wing rail can be extended by welding together two unilaterally metal-formed wing rails. In the sectional view according to FIG. 5, the starting profile of the wing rail, which is designed as a Vignol rail profile, is illustrated. FIG. 6 depicts the lower profile of the wing rail, which is produced by metal-forming, wherein it is apparent that the Vignol rail has been upset while maintaining the rail head profile such that a rail web 18 widened toward the rail foot 17 results. The rail profile produced by metal-forming is subsequently mechanically treated so as to result in the asymmetrical wing rail profile illustrated in FIG. 2.

In the main, the mode of construction according to the invention is substantially more cost-effective, since the necessary metal-forming to a modified profile can be performed in a single operation and connection welds can be omitted.

The invention claimed is:

1. A switch, comprising: a switch frog comprising a movable frog point and wing rails, wherein the wing rails each comprise a first region not in abutment with the frog point, a second region not in abutment with the frog point, and a third region of abutment with the frog point, said third region being arranged between said first and second regions, the wing rails each are formed by metal-forming from one single rail piece without any connection welds, the wing rails, in their first and second regions, have Vignol rail profiles, the wing rails, in their third region, have lower rail webs than a Vignol rail profile, the wing rails, in their third region, have rail profiles that are lower in height than the wing rails in their first and second regions, and are formed by metal-forming to depart from a Vignol rail profile while maintaining their rail head profiles, and the wing rails, in their third region, have rail webs that, only in a lower region of said wing rails in their third region, are wider than the rail webs of the wing rails in their first and second regions.

2. A switch according to claim 1, wherein the wing rails (5, 6) are fixed by supports (12) which are screwed with the lower rail webs of the wing rails, said supports (12) each having a material taper substantially corresponding to the widening of the lower rail webs (18).

3. A switch according to claim 1, wherein the wing rails (5, 6) in their third region have asymmetrical rail cross sections, and the asymmetrical rail cross sections are formed by mechanical treatment subsequently to the metal forming.

4. A switch according to claim 1, wherein the wing rails (5, 6) in the third region are at least partially arranged on chairs (11).

5. A switch according to claim 1, wherein the wing rails (5, 6) in their third region each have a profile height that is smaller than a profile height of the frog point (2) by at least a height of a foot (9) of the frog point (2).

6. A switch according to claim 4, wherein chair (11) end sides facing the frog point (2) comprise recesses (14) for overlapping a foot (9) of the frog point (2) in an abutted position of the frog point (2).

7. A switch according to claim 2, wherein the wing rails (5, 6) in their third region have asymmetrical rail cross sections, and the asymmetrical rail cross sections are formed by mechanical treatment subsequently to the metal forming.

8. A switch according to claim 2, wherein the wing rails (5, 6) in their third region are at least partially arranged on chairs (11).

9. A switch according to claim 3, wherein the wing rails (5, 6) in their third region are at least partially arranged on chairs (11).

10. A switch according to claim 2, wherein the wing rails (5, 6) in their third region each have a profile height that is smaller than a profile height of the frog point (2) by at least a height of a foot (9) of the frog point (2).

11. A switch according to claim 3, wherein the wing rails (5, 6) in their third region each have a profile height that is smaller than a profile height of the frog point (2) by at least a height of a foot (9) of the frog point (2).

12. A switch according to claim 4, wherein the wing rails (5, 6) in their third region each have a profile height that is smaller than a profile height of the frog point (2) by at least a height of a foot (9) of the frog point (2).

13. A switch according to claim 5, wherein chair (11) end sides facing the frog point (2) comprise recesses (14) for overlapping the foot (9) of the frog point (2) in an abutted position of the frog point (2).

14. A switch, comprising: a switch frog comprising a movable frog point and wing rails, wherein the wing rails each comprise a first region not in abutment with the frog point, a second region not in abutment with the frog point, and a third region of abutment with the frog point, said third region being arranged between said first and second regions, the wing rails each are formed by metal-forming from one single rail piece without any connection welds, the wing rails, in their first and second regions, have Vignol rail profiles, the wing rails, in their third region, have lower rail webs than a Vignol rail profile, the wing rails, in their third region, have rail profiles that are lower in height than the wing rails in their first and second regions, and are formed by metal-forming to depart from a Vignol rail profile while maintaining their rail head profiles, the wing rails, in their third region, have rail webs that, only in a lower region of said wing rails in their third region, are wider than the rail webs of the wing rails in their first and second regions, the wing rails (5, 6) are fixed by supports (12) which are screwed with the lower rail webs of the wing rails, said supports (12) each having a material taper substantially corresponding to the widening of the lower rail webs (18), the wing rails (5, 6) in their third region have asymmetrical rail cross sections, and the asymmetrical rail cross sections are formed by mechanical treatment subsequently to the metal forming, the wing rails (5, 6) in their third region are at least partially arranged on chairs (11), the wing rails (5, 6) in their third region each have a profile height that is smaller than a profile height of the frog point (2) by at least a height of a foot (9) of the frog point (2), and chair (11) end sides facing the frog point (2) comprise recesses (14) for overlapping a foot (9) of the frog point (2) in an abutted position of the frog point (2).

* * * * *